United States Patent [19]

Gruetzman

[11] 3,996,410

[45] Dec. 7, 1976

[54] METHOD AND COMPOSITION FOR TREATING SUBSTRATES AND COATED ARTICLES OBTAINED THEREBY

[75] Inventor: Stanley A. Gruetzman, Shoreview, Minn.

[73] Assignee: Andersen Corporation, Bayport, Minn.

[22] Filed: May 7, 1975

[21] Appl. No.: 575,365

Related U.S. Application Data

[63] Continuation-in-part of Ser. No. 507,371, Sept. 19, 1974, abandoned.

[52] U.S. Cl. ..... 428/539; 106/285; 427/27; 427/33

[51] Int. Cl.[2] ..... B05D 1/06

[58] Field of Search ..... 427/27, 28, 29, 30, 427/31, 32, 33, 27 NC; 428/539; 106/285

[56] References Cited

FOREIGN PATENTS OR APPLICATIONS

| | | | |
|---|---|---|---|
| 1,509,010 | 12/1967 | France | 427/27 NC |
| 22,481 | 1963 | Japan | 427/27 NC |

*Primary Examiner*—John H. Newsome
*Attorney, Agent, or Firm*—Thomas M. Meshbesher

[57] ABSTRACT

Non-conductive substrates are prepared for electrostatic coating by pre-treatment with a conductivity-improving composition comprising an alkali metal hydroxide (less than 5 wt. %) and a solvent system for the alkali metal hydroxide comprising a lower alkanol and a hydrocarbonaceous co-solvent. The solvent system flashes off rapidly, but electrical conductivity is not lost. Consequently, production line electrostatic coating techniques can be used, and the residual solvent system does not generally have an adverse effect upon adherence of the electrostatically-sprayed coating to the substrate.

9 Claims, No Drawings

METHOD AND COMPOSITION FOR TREATING SUBSTRATES AND COATED ARTICLES OBTAINED THEREBY

CROSS REFERENCE TO RELATED APPLICATION

This application is a continuation-in-part of my copending application, Ser. No. 507,371, filed Sept. 19, 1974 now abandoned.

FIELD OF THE INVENTION

This invention relates to a method for coating electrically non-conductive substrates by means of electrostatic projection of a coating composition which can contain a pigment. An aspect of this invention relates to means and techniques for preparatory treatment of the substrate for the purpose of improving the electrical conductivity of the surface prior to electrostatic coating.

DESCRIPTION OF THE PRIOR ART

It is well known that polar liquids such as water or alcohols, and ionizable compounds such as quaternary ammonium salts can be used as a preparatory treatment for a substrate which is to be electrostatically coated, whereby the electrical conductivity of the substrate surface is improved and the electrostatic spraying process is made more efficient. This pre-treatment step is particularly desirable when the electrically non-conductive (or substantially non-conductive) substrate comprises glass or organic polymers (e.g. vinyl polymers, acrylates, styrene polymers, and the like).

If the non-conducting substrate is to be coated with a paint, lacquer, varnish, or similar organic coating agent, it is often desirable to pre-treat with a non-aqueous medium, and this factor, among others, is one of the reasons for preferring the treatment with organic polar liquid such as the lower alkanols. The more highly polar alkanols such as the $C_1$–$C_4$ alkanols are relatively volatile materials and this can be both an advantage and a disadvantage. If rapid flash-off of excess organic polar liquid is desirable, volatility can be an advantage. The disadvantage connected with volatility is that the rate of evaporation is governed by ambient conditions (such as temperature) which may be poorly controlled. If evaporation is too rapid, dryness could result, and the substrate could revert to the non-conductive state.

It has been suggested to include relatively non-volatile materials in the conductivity-improving polar liquid, e.g. phosphoric acid, sulfur trioxide, sulfonic acid salts, the "Cellosolves" (trademark of Union Carbide), salts of organic acids, and polymeric polyols. Some disadvantages can also be encountered with the combination of organic solvents and these relatively less volatile materials, however. For example, the increase in efficiency and control over conductivity obtained with these additives may not justify the cost of their use. Stated another way, since the primary purpose of the pre-treatment is to improve electrical conductivity, and since the organic polar liquids and non-volatile additives do not become a functioning part of the electrostatically sprayed coating (e.g. a lower alkanol may be irretrievably lost through volatilization), the overall efficiency of the pre-treatment is crucial. Materials used for pre-treatment should be highly effective, readily available, and substantially inert toward the substrate and the electrostatically sprayed coating.

Furthermore, a polar, non-volatile additive for the pre-treatment solution should preferably have no effect upon the adherence of the electrostatically sprayed coating to the substrate.

SUMMARY OF THE INVENTION

Briefly, this invention involves an electrostatic spraying process for non-conductive substrates wherein the conductivity of the substrate is improved by means of pre-treatment with a composition comprising 95–99.9% by weight of a mixture of organic liquids and 0.1–5% by weight of an alkali metal hydroxide, preferably sodium or potassium hydroxide. The organic liquids which make up the bulk of the pre-treatment solution preferably include at least 10% by weight of a $C_1$–$C_4$ alkanol capable of readily dissolving solid alkali metal hydroxide, the balance of the liquid system being a relatively low-boiling hydrocarbonaceous liquid, preferably a straight-run coal or petroleum distillate.

The weight/weight ratio of the alkanol component to the hydrocarbon liquid components can typically be in the range of 1:9 to 9:1. Surprisingly, minor amounts of the alkanol are effective for dissolving the alkali metal hydroxide, and the preferred amount of alkanol is 15–45% by weight based on the weight of the entire treatment solution. This effectiveness has important practical ramifications. If it were necessary for the solvent, (i.e. organic liquid) system to be more than 50% by weight alkanol, it would virtually necessitate solvent recovery. Fortunately, it has been discovered that straight-run distillates obtained from petroleum and coal and the like do not detract from the objectives of this invention, so long as they comprise less than about 90 weight-% (more preferably less than 85 weight-%) of the solvent system.

Extremely small amounts of alkali metal hydroxide are effective in providing efficient improvement in conductivity of the substrate. For example, amounts of sodium hydroxide less than 1.0% by weight of the treatment solution are fully effective in this invention.

By providing an easily evaporated liquid with sufficient built-in electrical conductivity, a highly effective preparatory treatment for electrostatic spraying is obtained in a relatively brief transit of the substrate through a preparatory treatment zone. Much of the solvent of the preparatory treatment solution can "flash off" of the substrate before electrostatic spraying begins, and the adherence of the electrostatically sprayed paint or other organic coating to the pre-treated surface equals or exceeds the standards in the art.

DETAILED DESCRIPTION

It should be noted at the outset that the process of this invention is designed for continuous or semi-continuous operation. One significant application of the process of this invention relates to the electrostatic spray painting of glass panels, plastic coverings for millwork, and the like, wherein high production rates with high line speeds (e.g. in excess of about 3m/min) are desirable. The preparatory treatment of the plastic or glass, to be commercially practical, should be capable of being carried out at line speeds reasonably comparable to the speed of an electrostatic spraying line. A cumbersome batch-style pre-treatment would be ordinarily impractical.

Preparatory conductivity-improving pre-treatment can be carried out in pre-treatment zone, e.g. a bath into which articles headed for the spray line are dipped or a chamber in which articles can be sprayed with pre-treatment solutions. A bath is particularly effective, since complete and uniform pre-treatment of the plastic or glass article is often required. The duration of the preparatory treatment step can be less than 1 minute, more preferably less than 30 seconds, e.g. 0.5–20 seconds.

The next step in the process is evaporation of the solvent residue on the pre-treated substrate. Evaporation to complete dryness is neither necessary nor desirable. However, due to the ionizable nature of the alkali metal hydroxide solute, even in the presence of only residual amounts of solvent, atmospheric moisture, or the like, substantial evaporation of the solvent of the pre-treatment solutions does not result in reversion of the non-conductive state. Some paints and primers, (e.g. the polyurea type) can be adversely effected by residues of some solvents (e.g. V, M, and P naphtha) at least in terms of paint adherence, but the solvent systems preferred for use in this invention evaporate with sufficient speed to generally avoid this adverse effect upon these polyurea materials. Thus, the transit through the evaporation or flash-off zone is also very short in duration and does not slow down the production line. Normal ambient temperatures and pressure conditions (e.g. one atmosphere and 20°–30° C.) are adequate for rapid evaporation in the flash-off zone.

The electrostatic spraying step is conventional and need not be described in detail. It is, nevertheless, a key feature of the overall process, and the preceding process steps are essentially designed with electrostatic spraying in mind. Typically, the overall process is designed to provide a smooth, consistent, electrostatically sprayed coating of conventional thickness (e.g. 0.1–25 mils, more typically 0.5–3 mils.)

As is known in the art, it is generally simpler to arrange the electrostatic spraying equipment so that the conveyor line is grounded. This ensures that electrostatically sprayed particles projected by the spraying station will be attracted to the individual articles on the spraying line, in a very effective manner, resulting in a uniform and virtually flawless coating on each article. See, for example, the discussion in column 2, of U.S. Pat. No. 3,147,137 (Glass et al) issued Sept. 1, 1964. As pointed out by Glass et al, appropriate operations can be followed if it is desired to coat only one side (or other limited portions of a given substrate.

The conventional details of electrostatic spray-coating techniques are described in patent literature and other literature of the Ransburg Electro-Coating Corporation. Electrostatic equipment is also available from this company. See, for example, the various patents of Lester L. Spiller (U.S. Pat. No. 3,399,075 etc.) owned by this company. See also U.S. Pat. No. 3,348,965 (Drum) also owned by Ransburg. As pointed out in the Drum patent, potential differences used in electrostatic spray systems typically range from 10kv to about 100 kv. For a typical arrangement of circuitry with respect to an electrostatic spray-"loop", see the drawing of the aforementioned Glass et al patent. Once the articles have been given the preparatory treatment and then spray painted according to the teachings of this invention, additional steps which can be desirable (e.g. paint drying steps, additional coating steps, and the like) can be carried out in the conventional manner. Spray coated compositions can also be unpigmented, if desired. For example, glass panels can be electrostatically sprayed with conductive or reflective coatings.

NON-CONDUCTIVE SUBSTRATE MATERIALS

The non-conductive substrates used in this invention include inorganic materials such as glass, clay, ceramics, etc., and synthetic organic polymers, such organic polymers being typically in the form of coatings or shaped articles or films. (By "polymer" is meant homopolymers, copolymers, terpolymers, etc.) Polymers particularly useful in construction materials include the vinyls, (polyvinyl chloride, polyvinyl acetate, etc.) and acrylic, styrene, nitrile, and butadiene polymers. The polymers can be filled or extended with any of a variety of conventional fillers including metal oxides, silicates, and wood particles. This invention does not ordinarily contemplate the use of materials so high in wood content that a wood preservative treatment would be warranted. For example, phenolic plastic (phenol-aldehydes, etc.) or melamine plastics filled or blended with wood particles are useful in this invention, since the phenolic or melamine plastic protects the wood from attack by weather, fungi, and the like. For a description of a method and composition for a wood preservation pre-treatment along with a conductivity-improving pre-treatment, see the aforementioned parent application Ser. No. 507,371.

There is, however, a situation in which the method of this invention can be applied to wooden substrates. If the wooden article is strictly for indoor use (e.g. interior doors, molding, cupboards, etc., or indoor furniture), the wood preserving chemicals (e.g. biocidal wood preservative such as chlorinated phenols or organo-metallic compounds) can be omitted from the conductivity-improving solution.

THE SOLVENT SYSTEM

The function of the solvent system is at least threefold. First, its polar component, (i.e., the alkanol) helps to provide electrical conductivity. Second, the alkanol dissolves the alkali metal hydroxide. Third, the alkanol and the hydrocarbonaceous cosolvent (which are miscible) provide rapid "flash-off" characteristics and a lack of significant detrimental effects upon a variety of paints and primers, including alkyd and polyurea type. The solvent system as a whole preferably has low-boiling point generally well below 140° C. and more typically below 120° C. Ordinarily, more than 10% by weight of the solvent system should comprise the alkanol, the balance of the solvent being made up of the low-boiling hydrocarbonaceous liquid.

Methanol, though a technically operative alkanol, is ordinarily avoided because of its relatively higher toxicity as compared to ethanol (e.g. completely denatured alcohol) and primary and secondary propyl alcohol. The butanols are less preferred because of their relatively lower volatility. Optimum conductivity appears to be obtained with solutions containing isopropyl alcohol as the alkanol solvent.

As mentioned previously, it is preferred to dilute the lower alkanols with the hydrocarbonaceous co-solvent for practical reasons, e.g. reducing or eliminating the economic need for solvent recovery. That is, the co-solvent is a compatible diluent for the alcoholic solution of alkali metal hydroxide. Many relatively low boilding distillates consisting essentially of hydrocarbons (aliphatics and/or cycloaliphatics and/or aromatics) are available which have boiling points or boiling ranges with upper limits below 140° C. or, more preferably, below 120° C. Monocyclic hydrocarbons and straight or branched alkanes (or mixtures thereof) can be selected to have boiling points or ranges from just above normal ambient (e.g. 35° C.) up to moderately elevated temperatures (e.g. 100° C.). Higher boiling petroleum naphthas such as V, M, and P naphtha, however, are preferably excluded from the solvent system though they could be present in incidental amounts. Among the suitable commercially available distillates are the "LACOLENES" (trademark) and the "TROLUOILS" (trademark).

Alkali metal hydroxides (e.g. NaOH and KOH) readily dissolve in co-solvent mixtures of the distillate and the alkanol, particularly when more than 10% (e.g. more than 15%) of the solvent system is a $C_1$–$C_3$ alkanol.

The outstanding conductivity-improving effectiveness of inexpensive, inorganic bases such NaOH is believed to be a surprising feature of this invention.

PREFERRED PRE-TREATMENT SOLUTIONS AND MISCELLANEOUS INGREDIENTS

If desired, corrosion inhibitors and the like can be included in the pre-treatment solution to protect plastic/metal joints or interfaces which may be formed when articles treated according to this invention are used in construction. Any other additional ingredients which would not interfere with the objectives of this invention can be added to the pre-treatment solutions. Generally speaking, however, the pre-treatment solution will consist essentially of the following composition:

| Ingredient: | Percent by Weight Broad | Preferred | Optimum |
|---|---|---|---|
| Alkali metal hydroxide | 0.1–5 | 0.1–2 | 0.2–1.0 |
| Solvent System: | 95–99.9 | 98–99.9 | 99–99.8 |
| Alkanol component* | 10–90 | 15–45 | 15–40 |
| Hydrocarbon distillate component | qs–100 | qs–100 | qs–100 |

*Based on total system

ELECTROSTATIC SPRAY COATINGS

As mentioned previously, electrostatic spray coatings need not be pigmented. For example, the coatings can be a clear coating designed to provide greater electrical or thermal conductivity or light reflectivity. Pigmented coatings, however, are more typically used (e.g. paint and primers of the polyurea, alkyd, or latex type). When the substrate is glass, the electrostatically sprayed coating can be a material designed to provide opaqueness, e.g. for glass partitions and panels.

In the following non-limiting Example, parts and percentages are by weight unless otherwise indicated:

EXAMPLE

The following composition was used in a preparatory treatment bath or for an electrostatic spraying line. The production line and the bath were arranged to provide a 15-second treatment for articles made from polyvinyl chloride resin. This treatment and subsequent evaporation were carried out at normal ambient temperature and pressure. The vinyl articles were then electrostatically spray painted with a polyurea primer. An alkyd primer worked equally well in the process.

| Ingredient: | Percent by Weight |
|---|---|
| Sodium hydroxide, technical grade flake | 0.2 |
| Industrial isopropyl alcohol, 95–99% by weight purity (balance substantially water) | 33.2 |
| "Trouoil" (trademark for low boiling petroleum distillate) | 66.6 |

What is claimed is:

1. A process for the electrostatic coating of substantially electrically non-conductive inorganic substrate or synthetic organic polymeric substrate comprising the steps of:

a. placing the substrate in substantially continuous motion with a conveying means;

b. directing the substantially continuous motion of the substrate through a treatment zone for the treatment of said substrate with a liquid means comprising a liquid solution for improving its electrical conductivity, said liquid solution consisting essentially of:

98–99.9 percent by weight of a solvent system comprising a lower alkanol and a hydrocarbonaceous co-solvent miscible with said alkanol, said hydrocarbonaceous co-solvent having a boiling point below 140° C.; and 0.1–2 percent by weight of an alkali metal hydroxide dissolved in said solvent system;

c. directing the said substantially continuous motion of the thus-treated substrate, emerging from said treatment zone, through an evaporation zone to an electrostatic spraying zone; and d. electrostatically spraying the treated substrate with a coating composition in said electrostatic spraying zone.

2. A process according to claim 1 wherein said solvent system of said liquid solution comprises a major amount by weight of said hydrocarbonaceous co-solvent and a minor amount by weight of said lower alkanol.

3. A process according to claim 2 wherein said non-conductive substrate is a millwork article clad with a layer of vinyl polymer.

4. A process according to claim 1 wherein said liquid solution comprises:

0.2–1.0% by weight of sodium hydroxide,

15–40% by weight of a $C_2$ or $C_3$ alkanol, and the balance, to 100%, being a coal or petroleum hydrocarbon distillate having a boiling point below 120° C.

5. A process according to claim 4 wherein the electrostatic spraying step comprises the step of spraying the treated substrate with a polyurea or alkyd paint or primer.

6. A process according to claim 1 wherein the conditions of evaporation in said evaporation zone are normal ambient temperature and pressure.

7. A process for the electrostatic coating of wooden articles comprising the steps of:

a. placing the articles in substantially continuous motion with a conveying means;

b. directing the substantially continuous motion of the articles through a treatment zone for the treatment of said substrate with a liquid means comprising an electrical conductivity-improving liquid solution free of biocidal wood preservatives, said liquid solution consisting essentially of:

98–99.1 percent by weight of a solvent system comprising a lower alkanol and a hydrocarbonaceous co-solvent miscible with said alkanol, said hydrocarbonaceous co-solvent having a boiling point below 140° C., said solvent system comprising 15–40% by weight lower alkanol; and 0.1–2 percent by weight of an alkali metal hydroxide dissolved in said solvent system;

c. directing the said substantially continuous motion of the thus-treated articles, emerging from said treatment zone, through an evaporation zone to an electrostatic spraying zone; and d. electrostatically spraying the treated articles with a coating composition in said electrostatic spraying zone.

8. A composition for the preparatory treatment of non-conductive substrates consisting essentially of:

0.2–1.0% by weight of sodium hydroxide

15–40% by weight of a $C_2$ or $C_3$ alkanol; and the balance, to 100% being a coal or petroleum hydrocarbon distillate having a boiling point below 120° C.

9. An article pre-treated and electrostatically coated according to the process of claim 1.

* * * * *

UNITED STATES PATENT OFFICE

CERTIFICATE OF CORRECTION

Patent No. 3,996,410 Dated Dec. 7, 1976

Inventor(s) Stanley A. Gruetzman

It is certified that error appears in the above-identified patent and that said Letters Patent are hereby corrected as shown below:

Column 3, line 16, for "of" read --to--.

Column 3, line 47, for "substrate." read --substrate).--.

Column 4, line 44, for "has low" read --has a low--.

Column 4, line 63, for "boilding" read --boiling--.

Signed and Sealed this thirtieth Day of August 1977

[SEAL]

Attest:

RUTH C. MASON
*Attesting Officer*

C. MARSHALL DANN
*Commissioner of Patents and Trademarks*